United States Patent [19]

Pasquini

[11] 4,341,308

[45] Jul. 27, 1982

[54] CONTAINER FOR BOTTLES

[76] Inventor: William G. Pasquini, 913 S. Maple St., Montebello, Calif. 90640

[21] Appl. No.: 170,133

[22] Filed: Jul. 18, 1980

[51] Int. Cl.[3] ..... B65D 85/62; B65D 81/02

[52] U.S. Cl. ..... 206/427; 206/433; 206/485; 206/814; 206/45.14; 206/499; 206/516

[58] Field of Search ..... 206/485, 427, 433, 45.14, 206/814, 499, 516

[56] References Cited

U.S. PATENT DOCUMENTS

| | | | |
|---|---|---|---|
| 1,977,160 | 10/1934 | White | 206/433 |
| 2,229,427 | 1/1941 | Tanner | 206/45.14 |
| 2,339,176 | 1/1944 | Lee | 206/427 |

FOREIGN PATENT DOCUMENTS

| | | | |
|---|---|---|---|
| 1094745 | 5/1955 | France | 206/814 |

*Primary Examiner*—William T. Dixson, Jr.
*Attorney, Agent, or Firm*—Edgar W. Averill, Jr.

[57] ABSTRACT

An improved container for holding and displaying a plurality of beverage bottles. The container is of the type typically fabricated from corrugated particle board and has a base and a cover. The container has an improved bottle holder which has first and second inverted V-shaped bottle support members formed therein. The bottle support members hold the neck and body of a plurality of bottles which are positioned in the bottle support members.

11 Claims, 9 Drawing Figures

Fig. 6.
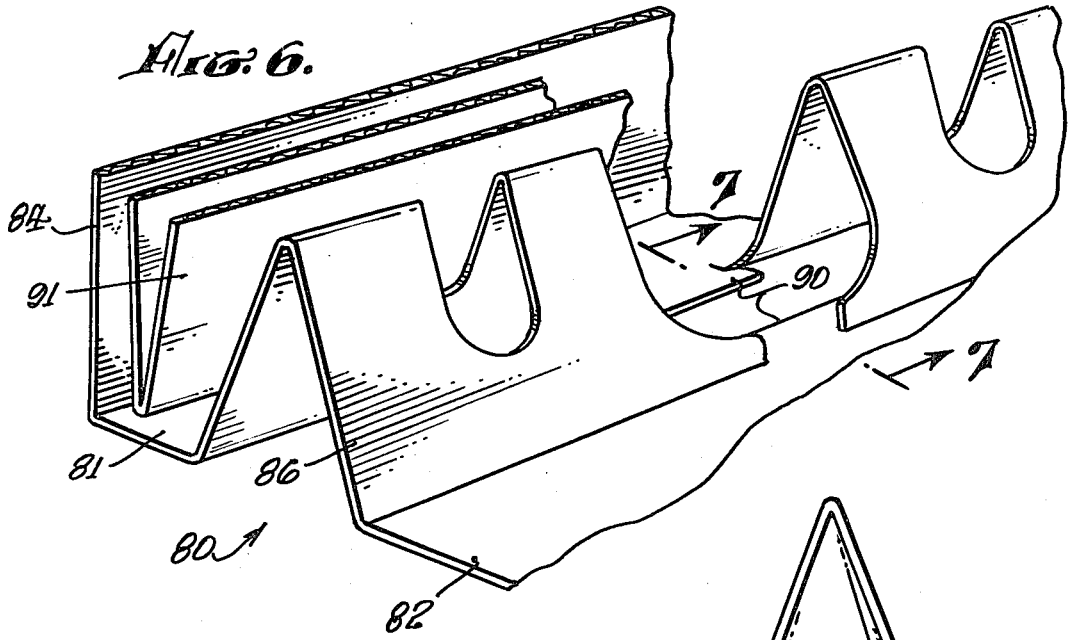
Fig. 7.
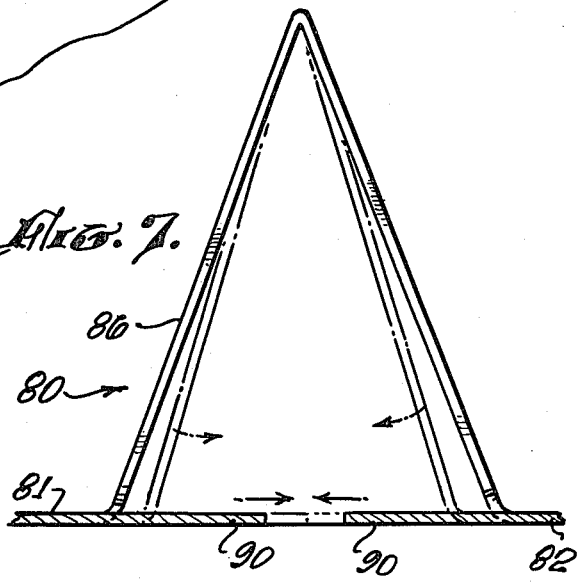
Fig. 8.
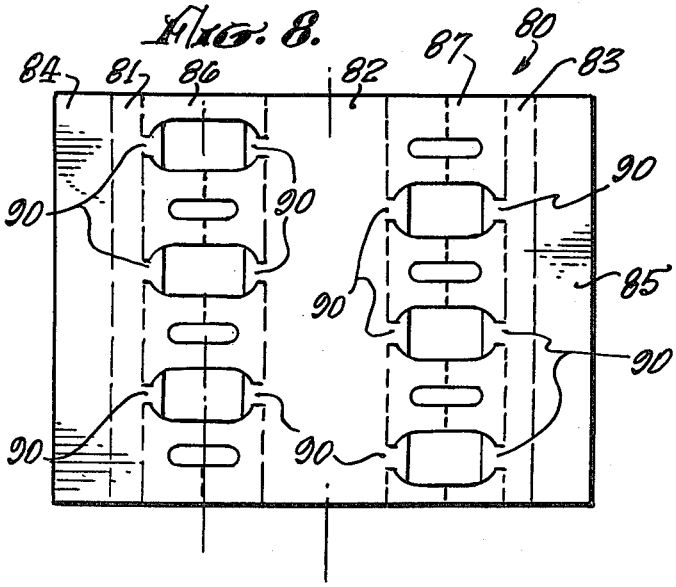
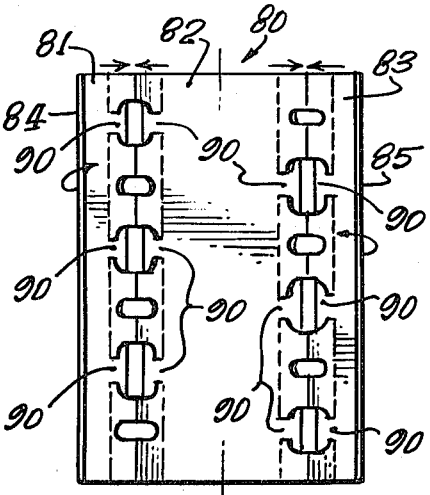
Fig. 9.

CONTAINER FOR BOTTLES

BACKGROUND OF THE DISCLOSURE

The field of the invention is containers or boxes, and the invention relates more particularly to boxes for shipping and displaying beverages.

Most beverage cases hold a plurality of beverage bottles in a vertical position, each bottle being separated from an adjacent bottle by a corrugated cardboard layer. While such containers have reached a high degree of design refinement and enable shipping with a minimum of breakage in a container of relatively low cost, such containers are deficient when a product such as wine reaches the retail outlet. After the cover of the wine case has been removed, only the top of the wine bottles are visible and prospective purchasers are not able to view the side of the bottle or the bottle label to assist them in choosing a wine. Furthermore, many wines are stoppered with a cork wich is preferably kept moist and therefore it is preferred that wine be shipped and stored in a position which retains the cork in a moist condition.

While wooden wine cases have been utilized for many years to ship and support wine bottles in a horizontal position, attempts to duplicate such wooden containers from corrugated particle board have been unsuccessful to date in that bottle breakage has occurred at an unacceptably high rate. Another difficulty associated particularly with the wine industry is that different sizes and shapes of wine bottles are used with different generic types of wine. Thus, the typical burgundy bottle is shorter than the typical rhine wine bottle. Since it is common for a single winery to produce and bottle wines in both burgundy and rhine wine style bottles, there is a need to provide a single container which is capable of shipping and displaying bottles of different sizes.

SUMMARY OF THE INVENTION

It is thus an object of the present invention to provide an improved container for holding a plurality of bottles, which container has the ability to be readily modified internally to support and display bottles of different sizes.

The present invention is for an improved container for holding a plurality of bottles, said container being of the type typically fabricated from corrugated particle board and having a base with a generally rectangular bottom, sides and ends. The container has a cover also having a generally rectangular top, sides and ends. The improvement comprises a bottle holder which is held within the base. The bottle holder has a length about equal to the length of the sides of the base and has a first end support flap, a first platform integral with the first end support flap and positioned at a right angle with respect thereto. A first inverted V-shaped support member is affixed at one edge to the first platform and extends upwardly and is affixed at its other edge to a center platform of the bottle holder. The second inverted V-shaped bottle support member is affixed at one edge to the center platform and extends upwardly therefrom and is affixed at its other edge to a second platform. An end support flap is integral with and positioned at a right angle with respect to the second platform. The first and second inverted V-shaped bottle support members have a plurality of bottle support slots formed therein, and the combined width of the first platform, the center platform and the second platform is between 15% and 35% less than the width of the bottom of the base whereby spacer means may be inserted between the end support flaps and the sides of the base to provide end supports for the bottles placed in the bottle support members. Preferably, the container has two separate layers or levels and preferably the bottle support members have alternate neck and body slots so that adjacent bottles are inverted in their orientation. It is also preferable that the platform have stop tabs to hold the base of the inverted "V" at a desired spacing.

BRIEF DESCRIPTION OF THE DRAWINGS

FIG. 6 is an enlarged fragmentary perspective view of a portion of an alternate configuration of the bottle holder of the present invention.

FIG. 7 is a cross sectional view taken along line 7—7 of FIG. 6.

FIG. 8 is a plan view of the bottle support member of the bottle holder of FIG. 6.

FIG. 9 is a plan view of the bottle support member of the bottle holder of FIG. 6.

DESCRIPTION OF THE PREFERRED EMBODIMENTS

Figure 1:
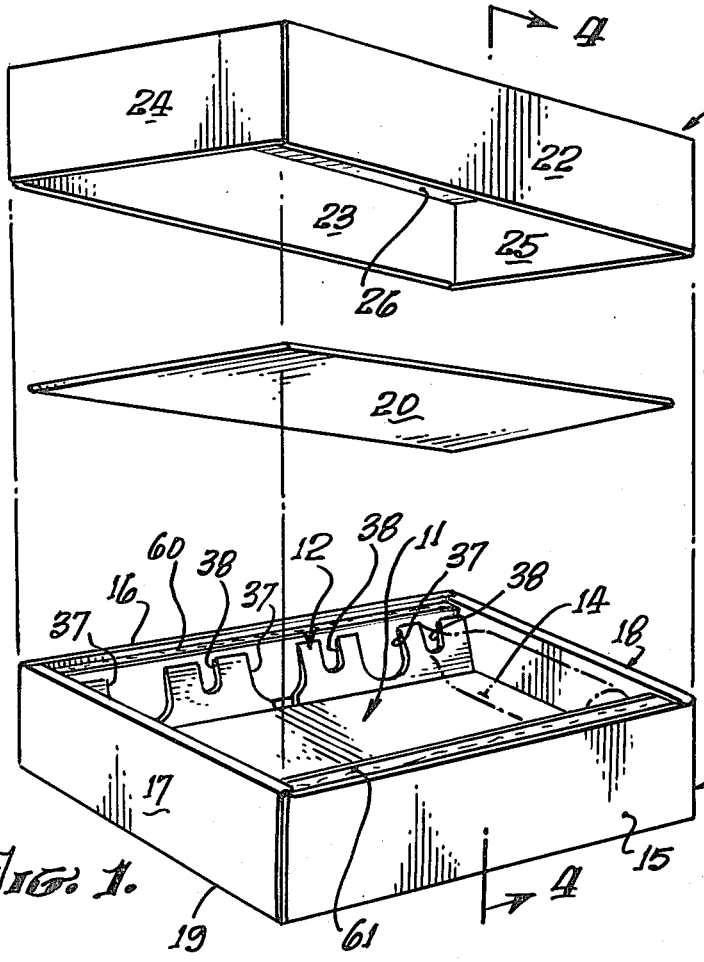
FIG. 1 is an exploded perspective view of the improved container of the present invention.
Figure 2:
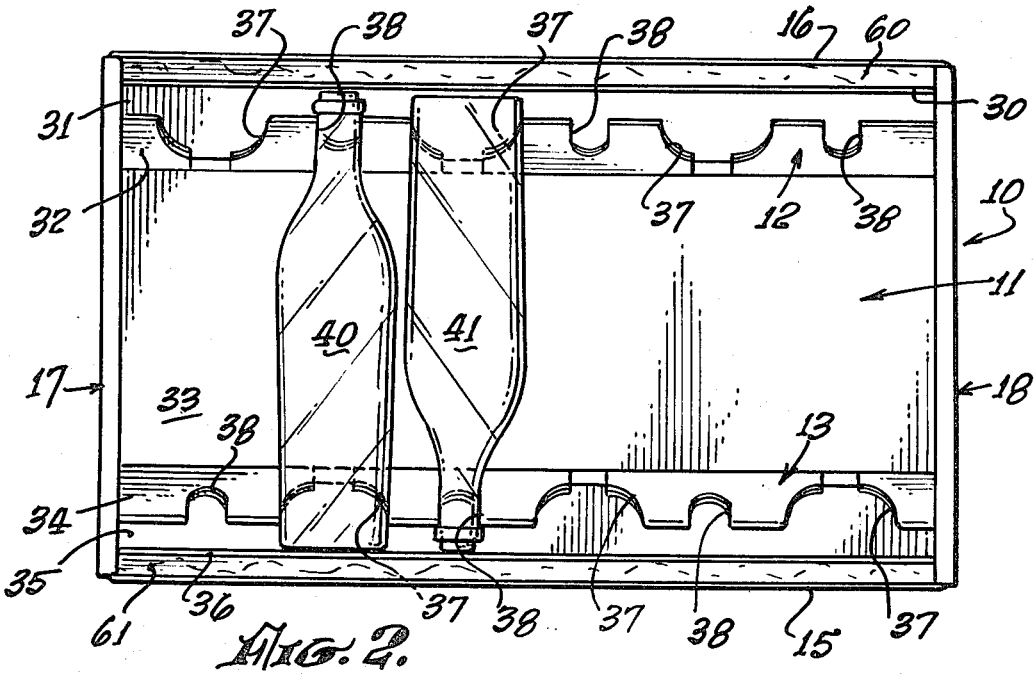
FIG. 2 is a top plan view of the base and bottle holder of the present invention.
Figure 5:
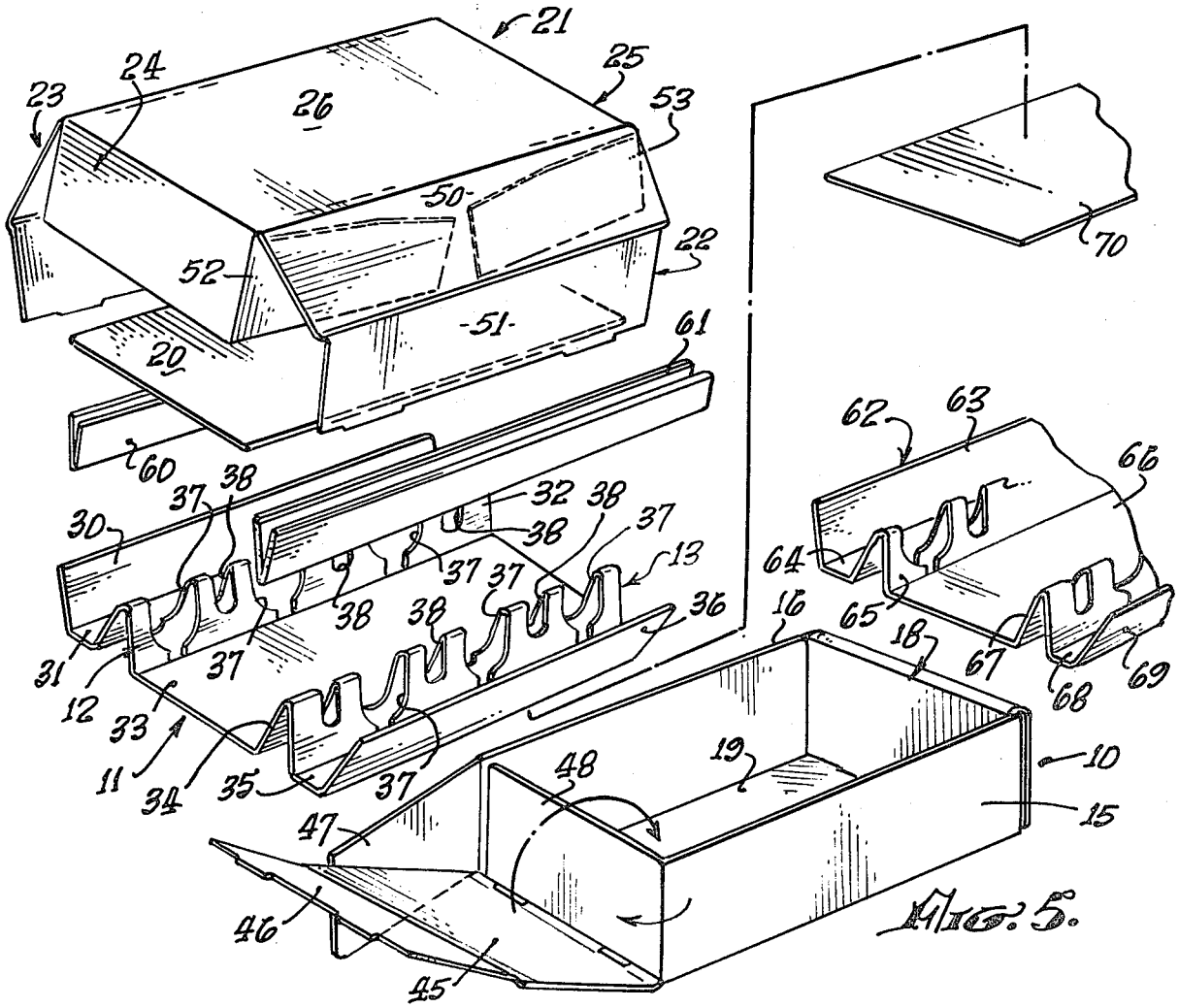
FIG. 5 is an exploded perspective view partly broken away of the container of FIG. 1.

The improved container of the present invention is shown in exploded perspective view in FIG. 1 and has a base generally indicated by reference character 10. Base 10 has two layers, the upper of which supports a bottle holder 11 which has a pair of inverted V-shaped bottle support members 12 and 13 (member 13 is not shown in FIG. 1 but is shown in FIG. 2). A bottle 14 is shown in phantom lines in FIG. 1. Base 10 has two generally rectangular sides 15 and 16 and two generally rectangular ends 17 and 18. The bottom, shown best in FIG. 5, is indicated by reference character 19.

A pad 20 is held above the bottle holder 11 and is a conventional corrugated cardboard pad. A cover 21 has sides 22 and 23, ends 24 and 25 and a top 26.

The bottle holder 11 is shown in plan view in FIG. 2 and has the following general elements:

an end support flap 30, a first platform 31, a first inverted V-shaped bottle support member 32, a center platform 33, a second inverted V-shaped bottle support member 34, a second platform 35 and a second end support flap 36. Support members 32 and 33 have alternate body and neck support slots, the body support slots being indicated by reference character 37 and the neck support slots being indicated by reference character 38. It is preferable that the body and neck support slots be alternated so that the bottles may be displayed and transported in alternate orientation as shown by bottles 40 and 41 in FIG. 2. It is possible, however, that all bottles be oriented in the same direction and all neck supports be in one V-shaped bottle support member and all body support slots be in the second bottle support member.

Figure 3:
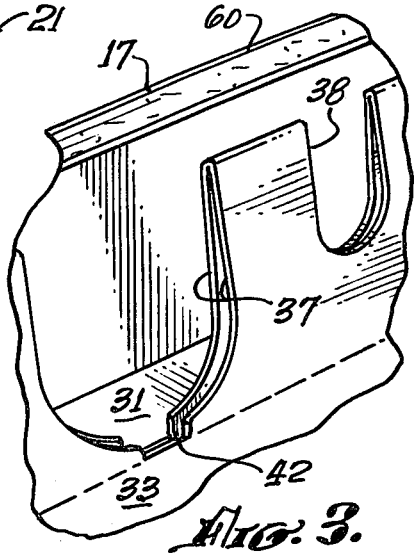
FIG. 3 is an enlarged fragmentary perspective view of a portion of the bottle holder of the present invention.

The body support slots should terminate above the level of the center platform 33 as shown best in FIG. 3 of the drawings where a space 42 is provided between platform 33 and the lowermost portion of slot 37. This helps to prevent bottle damage in the event the container is dropped.

The details of construction of one preferred embodiment of the present invention is shown best in the exploded view of FIG. 5. The generally rectangular base is fabricated from corrugated particle board and is of the type of construction typically referred to as a roll end base in that ends 17 and 18 are formed by rolling over an end flap so that a multiple number of layers exist between the inside and the outside of the ends of the base. For instance, end 17 has four layers namely flaps 45, 46, 47 and 48 after it has been folded over as indicated by the arrows of FIG. 5. This, of course, provides substantial protection against impact against the ends. Similarly, end 18 is formed by rolling over an end flap as described above for end 17. Cover 21 is a roll side cover which also provides multiple layer protection for the sides of the covered container. For instance, side 22 has three layers consisting of flaps 50, 51, and 52 or 53. Flap 51 is held in place by a pair of tabs which mate with a pair of slots in cover 21 in a conventional manner.

A very useful feature of the present invention is the ability of the container to be adapted to hold bottles of different lengths. This may be done without any change in the cover or base or bottle holders and may be carried out by the insertion or one or more filler spacers indicated in FIG. 5 by reference characters 60 and 61. The use of these spacers will be described in more detail below. The bottom layer bottle holder is indicated generally by reference character 62 and has the following elements:

end support flaps 63, first platform 64, first inverted V-shaped bottle support member 65, center platform 66, second inverted V-shaped bottle support member 67, second platform 68 and second end support flap 69. A pad 70 is preferably positioned between the upper layer bottle holder 11 and the lower layer bottle holder 62.

Figure 4:
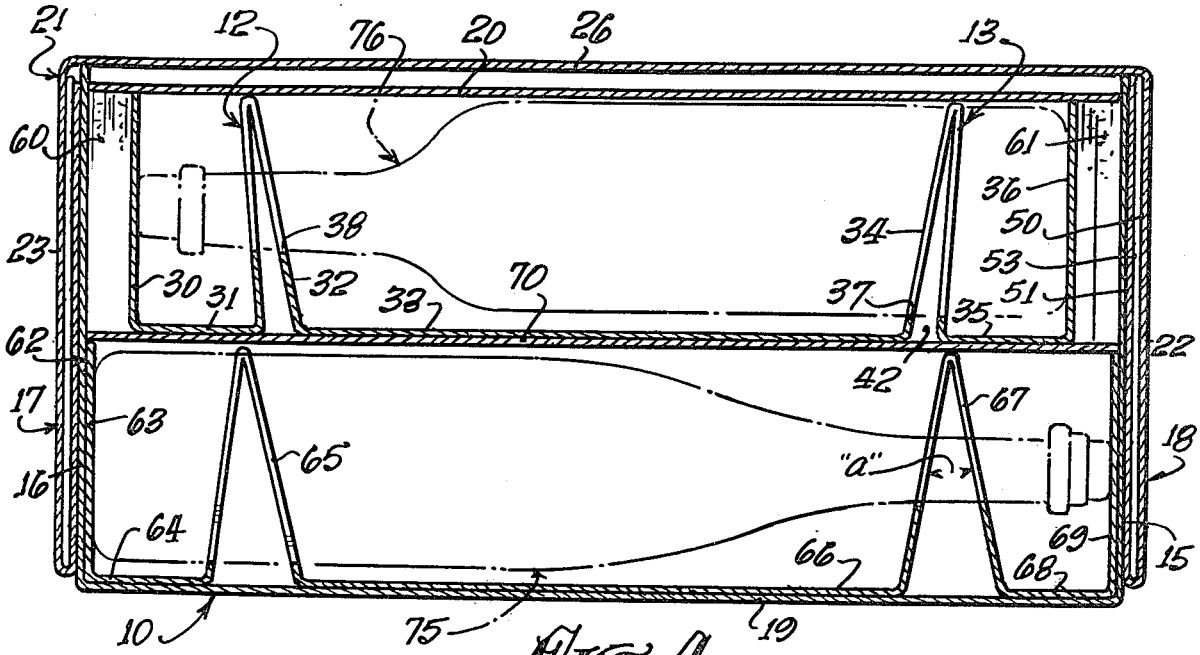
FIG. 4 is an enlarged cross-sectional view taken along line 4—4 of FIG. 1.

As shown best in FIG. 4, the container of the present invention is capable of holding bottles of different lengths while utilizing the same bottle holder members, the same base and the same cover. A bottle 75 is of a shape generally referred to as a rhine wine bottle which has a greater height than the burgundy bottle 76 also shown in FIG. 4. In order to prevent damage during shipping, it is beneficial that the ends of any beverage container held within the container be supported and touch or about touch at both the base and top. This prevents damage by shifting. In order to accomplish this, the bottle holder of the container of the present invention has the ability to accordion by the insertion of spacers such as spacers 60 and 61 so that this desired contact may be accomplished. Alternatively, as shown in FIG. 6 of the drawing, the spacer may be inserted inside the end support flap. Thus, without the insertion of spacers, rhine wine bottle 75 contacts end support 63 at its base and end support flap 69 at its cork. Also because of the insertion of spacers 60 and 61, burgundy bottle 76 contacts end support flap 30 at its cork and end support flap 36 at its base.

The combined width of the first platform, center platform and second platform is less than the overall width of the bottom 19 of base 10 to provide a spacer for the bottom of the inverted "V". This combined width should be between 15% and 35% less than the width of the bottom and preferably about 30%. This same feature may be expressed as an angle measured when the inverted V-shaped bottle support member is in its most upright position. Thus, as shown in the lower layer of FIG. 4, this angle is indicated by reference character "a" in FIG. 4 and should not exceed 40° when the bottle holder is used without spacers. Preferably this angle should be between 25° and 40° with about 33° being preferred. The top of the inverted V-shaped bottle support member should preferably extend so that it about touches the pad 20 or 70 to provide additional support.

The container of the present invention has been shown capable of passing a test involving dropping a case filled with six wine bottles filled with water from a height of 24 inches ten times onto a steel plate with no bottles breaking. This drop test was performed after subjecting the case to a vibration test for 63 minutes at 225 CPM. The particle board used to fabricate the container comprised 275 pound stock with a "C" corrugation. The container upon receipt at its retail destination may simply be opened and provides an attractive display for its contents.

An alternate configuration of the present invention is shown in FIGS. 6, 7, 8 and 9. The bottle holder analogous to bottle holder 11 of FIG. 5 is indicated by reference character 80 in FIG. 6. It has a first platform 81, a center platform 82 and a second platform 83 shown in FIGS. 8 and 9 of the drawings), and the support flaps 84 and 85 perform the same functions as their counterparts in FIG. 5. The V-shaped bottle support member is indicated by reference character 86 in FIG. 6 and 87 in FIGS. 8 and 9.

The novel feature of this configuration is the plurality of spacer tabs 90 which hold the bottom of V-shaped support 86 from becoming too narrow. This also prevents the possibility that the bottom of one V-shaped support member (for instance member 86) could become very narrow and the base of support member 87 could become very wide. However, the use of tabs 90 prevents such occurence and helps assure the desired angle of the support member to be held.

The spacer member 91 may be inserted within end support flap 84 to accomodate different lengths of wine bottles.

As mentioned above, the container of the present invention may be made in different sizes and one particularly preferred configuration is a wine "six pack" where the container shown in FIGS. 4 and 5 is divided horizontally so that just one layer is utilized. In this configuration, all six bottles may be viewed by the prospective buyer.

It is further possible to modify the holders of the present invention to hold a single magnum bottle which is also capable of passing a test of being dropped from a height of 30 inches ten times onto a steel plate.

While the container of the present invention has been indicated as being fabricated from the corrugated particle board, it is, of course, possible that other materials of construction could be used such as polyfoam sheeting material. It is important, however, that the material of construction be flexible to accomplish the necessary accordion effect, and a particular advantage of the present invention is its ability to be fabricated from relatively inexpensive material such as corrugated particle board. However, since other materials of construction are likely to be developed which are equivalent to these, these materials, of course, may be used in place of the conventional materials.

The present embodiments of this invention are thus to be considered in all respects as illustrative and not restrictive; the scope of the invention being indicated by the appended claims rather than by the foregoing description. All changes which come within the meaning and range of equivalency of the claims therefore are intended to be embraced therein.

What is claimed is:

1. An improved container for holding a plurality of bottles, said container being of the type typically fabricated from corrugated particle board and having a base with a generally rectangular bottom, sides and ends, and a cover member having a generally rectangular top, sides and ends, wherein the improvement comprises:

a bottle holder having a length about equal to the length of the sides of the base, said bottle holder being held on said bottom and having a first end support flap, a first platform integral with and positioned at a right angle with respect to the first end support flap, a first, inverted V-shaped bottle support member affixed at one edge thereof and extending upwardly from said first platform and affixed at its other edge to a center platform of the bottle holder, a second inverted V-shaped bottle support member affixed at one edge thereof and extending upwardly from the center platform and affixed at the other edge to a second platform and an end support flap integral with and positioned at a right angle to the second platform, said first and second inverted V-shaped bottle support members having a plurality of bottle support slots formed therein and wherein the combined width of the first platform, the center platform and the second platform is between 15% and 35% less than the width of the base, whereby spacer means may be inserted between said end support flaps and sides of the base to provide end support for the bottles placed in the bottle support members.

2. The improved container of claim 1 wherein said inverted V-shaped bottle support members have alternate body and neck support slots positioned therein.

3. The improved container of claim 2 wherein each inverted V-shaped bottle support member has three body slots and three neck slots.

4. The improved container of claim 1 wherein said container has two layers, each layer having a bottle holder.

5. The improved container of claim 1 wherein said combined width is about 30% less than the width of the base.

6. The improved container of claim 1 wherein said container has a roll end base.

7. The improved container of claim 1 wherein said container has a roll side cover.

8. The improved container of claim 1 wherein said container has a roll end base and a roll side cover.

9. The improved container of claim 1 wherein said container has a roll side cover, a roll end base and two layers of bottle holders.

10. The improved container of claim 1 wherein said inverted V-shaped bottle support member has bottle support slots which have spacer tabs positioned in the same plane as that occupied by the center, first and second platforms.

11. An improved container for holding a plurality of bottles, said container being of the type typically fabricated from corrugated particle board and having a base with a generally rectangular bottom, sides and ends, and a cover member having a generally ractangular top, sides and ends, wherein the improvement comprises:

a bottle holder having a length about equal to the length of the sides of the base, said bottle holder being held on said bottom and having a first end support flap, a first platform integral with and positioned at a right angle with respect to the first end support flap, a first, inverted V-shaped bottle support member affixed at one edge thereof and extending upwardly from said first platform and affixed at its other edge to a center platform of the bottle holder, a second inverted V-shaped bottle support member affixed at one edge thereof and extending upwardly from the center platform and affixed at the other edge to a second platform and an end support flap integral with and positioned at a right angle to the second platform, said first and second inverted V-shaped bottle support members having a plurality of bottle support slots formed therein and wherein the combined width of the first platform, the center platform and the second platform is about 30% less than the width of the base, and spacer tabs positioned in the same plane as the center and first and second platforms to fix the minimum width of the bottom of said inverted V-shaped bottle support members.

* * * * *